US009812830B1

(12) United States Patent
Chuang

(10) Patent No.: US 9,812,830 B1
(45) Date of Patent: Nov. 7, 2017

(54) EXTENDIBLE ELECTRICAL SOCKET HAVING A PLURALITY OF ELECTRICAL SOCKETS MECHANICALLY AND ELECTRICALLY INTERCONNECTED

(71) Applicant: WEI LEE ELECTRICAL INC, Taoyuan (TW)

(72) Inventor: Yu-Chin Chuang, Taoyuan (TW)

(73) Assignee: Wei Lee Electrical Inc., Taoyuan (TW)

( * ) Notice: Subject to any disclaimer, the term of this patent is extended or adjusted under 35 U.S.C. 154(b) by 0 days.

(21) Appl. No.: 15/462,143

(22) Filed: Mar. 17, 2017

(51) Int. Cl.

| | |
|---|---|
| ***H01R 9/22*** | (2006.01) |
| ***H01R 25/00*** | (2006.01) |
| ***H01R 13/514*** | (2006.01) |
| ***H01R 13/11*** | (2006.01) |

(52) U.S. Cl.
CPC ..... *H01R 25/006* (2013.01); *H01R 13/11* (2013.01); *H01R 13/514* (2013.01)

(58) Field of Classification Search
CPC ..... H01R 9/22; H01R 13/426; H01R 13/11; H01R 13/514; H01R 13/518; H01R 24/525; H01R 25/006; H01R 31/06
USPC ..... 439/535, 652, 653, 654, 701, 717
See application file for complete search history.

(56) References Cited

U.S. PATENT DOCUMENTS

| | | | | |
|---|---|---|---|---|
| 4,425,018 | A * | 1/1984 | Stenz | H01R 9/2408 439/716 |
| 4,469,393 | A * | 9/1984 | Chewning, Jr. | H01R 13/514 439/717 |
| 7,907,423 | B2 * | 3/2011 | Lopes | B60R 16/0238 361/630 |
| 8,947,859 | B2 * | 2/2015 | Froschmeier | B60R 16/0238 307/9.1 |
| 9,124,081 | B2 * | 9/2015 | Kowtun | H02G 3/16 |
| 2009/0091183 | A1 * | 4/2009 | Lopes | B60R 16/0238 307/9.1 |
| 2012/0228929 | A1 * | 9/2012 | Froschmeier | B60R 16/0238 307/9.1 |

* cited by examiner

*Primary Examiner* — Chandrika Prasad
(74) *Attorney, Agent, or Firm* — Wang Law Firm, Inc.

(57) ABSTRACT

An extendible electrical socket includes: a mother socket connected to a power supply source; and a plurality of daughter sockets which are connectable with one another to be an extendible electrical socket adapted for simultaneously connecting a plurality of electrical devices; each daughter socket including a locking device to be safely engaged with the mother socket or engaged with another or neighboring daughter socket to prevent from their disconnection when coupled and locked by each locking device.

10 Claims, 14 Drawing Sheets

EXTENDIBLE ELECTRICAL SOCKET HAVING A PLURALITY OF ELECTRICAL SOCKETS MECHANICALLY AND ELECTRICALLY INTERCONNECTED

BACKGROUND OF THE INVENTION

A conventional connectable electrical socket as shown in FIG. 14 comprises: a plurality of sockets (50) which are connectable with one another to be an extended electrical socket device for simultaneously connecting and powering a plurality of electrical devices.

Each socket (50) comprises a plug (51) which may be formed with a pair of parallel pins or blades adapted to be connected to a power source or connected to a neighboring socket (50); and a pair of socket holes (52) to be connected with a plug (51) of another neighboring socket (50) when connected to be an extended electrical socket device.

However, such a conventional electrical socket device is lacking of any locking or engaging mechanism. When an external pulling force F is acting upon the connected sockets (50) as shown in FIG. 14, the sockets (50) may then be disconnected to stop the normal power supply and may influence the stability of power supply as provided to any electrical device connected with the socket.

Meanwhile, each socket (50) includes each plug (51) which is always protruding outwardly to thereby cause inconvenience when stored or carried.

The present inventor has found the drawbacks of the conventional connectable electrical socket, and invented the present electrical socket for stably connecting a plurality of sockets to be an extendible electrical socket device which can be used safely and be stored conveniently.

SUMMARY OF THE INVENTION

The object of the present invention is to provide an extendible electrical socket including: a mother socket connected to a power supply source; and a plurality of daughter sockets which are connectable with one another to be an extendible electrical socket for simultaneously connecting a plurality of electrical devices; each daughter socket including a locking device to be safely engaged with the mother socket or engaged with another or neighboring daughter socket to prevent from their disconnection when coupled and locked by each locking device.

DETAILED DESCRIPTION

Figure 1:
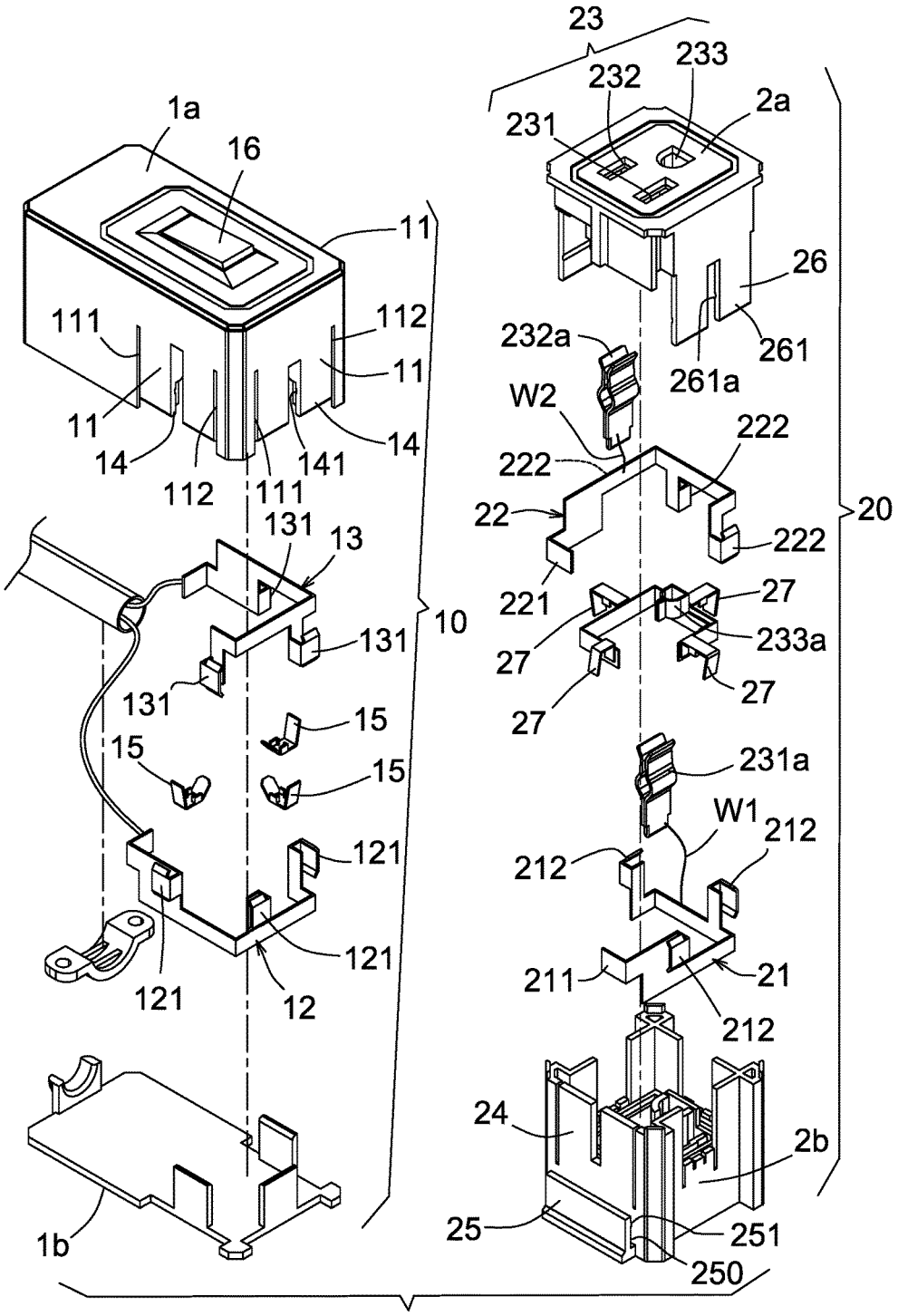
FIG. 1 is an exploded view showing the elements of the present invention.

As shown in FIGS. 1-10, the present invention comprise: a mother socket 10; and at least a daughter socket 20 extendibly connected with the mother socket 10.

The mother socket 10 comprises at least one or plural mother connecting portions 11 on one side or plural sides of the mother socket 10 to be connected with one or plural daughter sockets 20 on the side or sides of the mother socket 10. The mother socket 10 comprises a first conducting plate 12 and a second conducting plate 13 respectively connected to two electrodes (or a positive pole and a negative pole) of a power supply source (not shown).

The first conducting plate 12 includes a least one or plural first output contactors 121, while the second conducting plate 13 including at least one or plural second output contactors 131, both output contactors 121, 131 respectively formed on or in each mother connecting portion 11.

Each mother connecting plate 11 includes a mother output terminal 14 having a first engaging portion (or recess) 141 formed on said mother output terminal 14.

Each daughter socket 20 includes a first conductor 21, a second conductor 22 and a plug-in socket 23 having a plurality of socket holes 231, 232, 233 adapted for insertion of a plug (plug pins, not shown). Each socket hole 231, 232, 233 is projectively aligned with a conducting clips 231*a*, 232*a*, 233*a*. A conducting clip 231*a* is electrically connected to the first conductor 21 by a first wire W1 (FIG. 1), while another conducting clip 232*a* is electrically connected to the second conductor 22 by a second wire W2.

Each daughter socket 20 includes a daughter input terminal 24 on a side of the socket 20 adapted to be contacted with a mother output terminal 14 for connecting the daughter socket 20 with the mother socket 10 (FIG. 7); and at least (or plural) daughter connecting terminal(s) 26 adapted to be connected with a neighboring daughter socket 20.

The first conductor 21 includes a first input contactor 211 protruding outwardly through the daughter input terminal 24 to be electrically contacted with a first output contactor 121 of the first conducting plate 12. The second conductor 22 includes a second input contactor 221 protruding outwardly through the daughter input terminal 24 to be electrically contacted with a second output contactor 131 of the second conducting plate 13 (FIGS. 1, 2, 4 and 8).

A daughter engaging member 25 is protruded outwardly from the daughter input terminal 24 and defining a daughter engaging groove 250 between the daughter engaging member 25 and the daughter input terminal 24 to be engaged with a first wall 111*a* of first sliding groove 111 and with a first wall 112*a* of second sliding groove 112 (FIGS. 2, 7 and 8), thereby locking the daughter socket 20 with the mother socket 10 without being loosened or disconnected by a pulling force longitudinally acting upon the daughter socket 20.

The first sliding groove 111 is defined between a first wall 111*a* of the first sliding groove 111 and a second wall 111*b* of the first sliding groove 111. The second sliding groove 112 is defined between a second wall 112*a* of the second sliding groove 112 and a second wall 112*b* of the second sliding groove 112.

Figure 8:
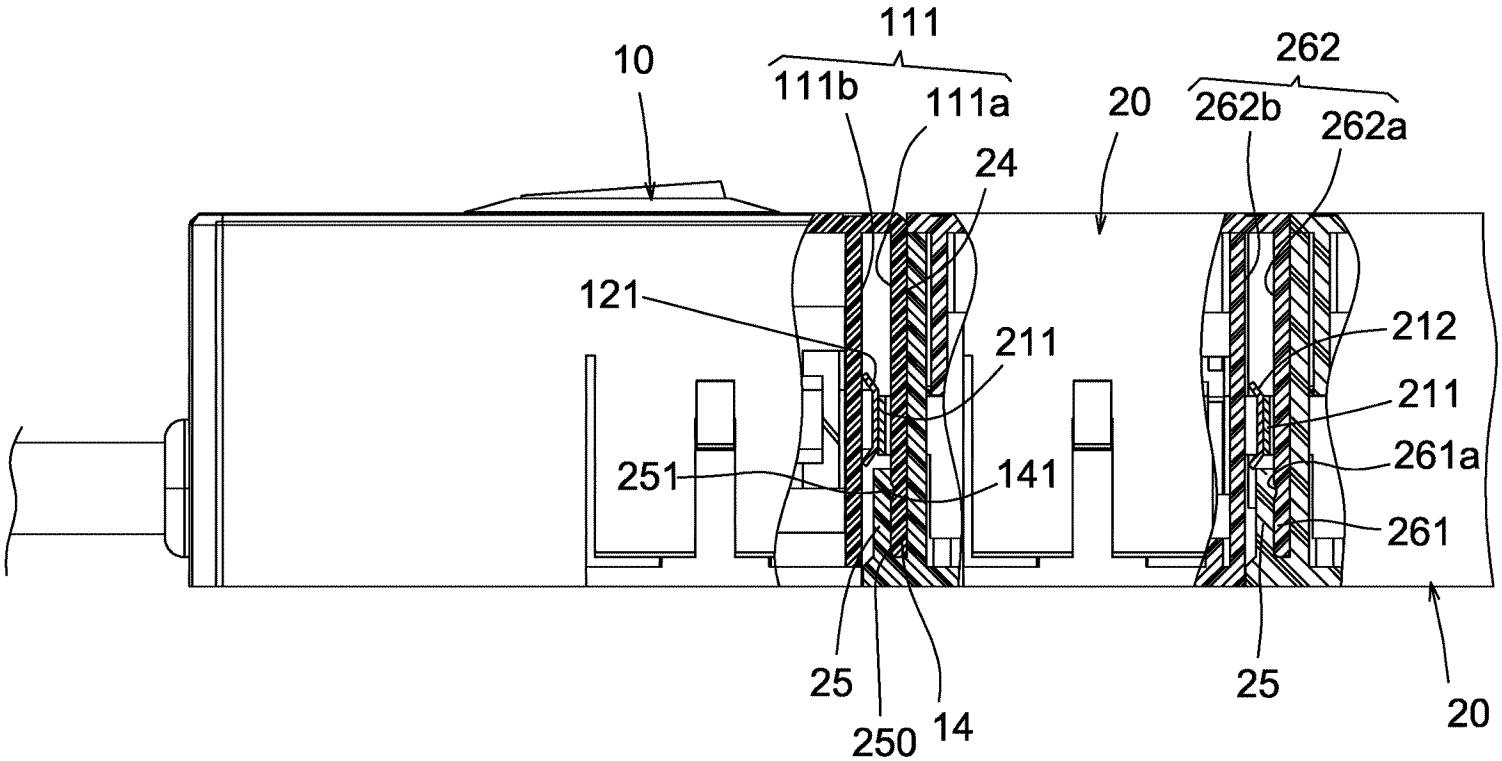
FIG. 8 is a partial sectional drawing showing the connection of a mother socket with daughter sockets.

As shown in FIG. 8, the first output contactor 121 of the first conducting plate 12 of the mother socket 10 is contacted with the first input contactor 211 of the first conductor 21 of the daughter socket 20, and both first output contactor 121 (of mother socket 10) and the first input contactor 211 (of daughter socket 20) are contacted and confined within the first sliding groove 111 (FIG. 8), as resiliently urged by both the first wall 111*a* and second wall 111*b* of the first sliding groove 111 to help resiliently contacting between the first output contactor 121 of the mother socket 10 and the first input contactor 211 of the daughter socket 20 to enhance electrical connection and power transmission from the mother socket 10 to the daughter socket 20.

Similarly, both the second output contactor 131 (of mother socket 10) and the second input contactor 221 (of daughter socket 20) are contacted and confined within the second sliding groove 112 as resiliently urged by the first wall 112*a* and second wall 112*b* of the second sliding groove 112, thereby making a resilient and well contacting between the second output contactor 131 (of mother socket 10) and the second input contactor 221 (of daughter socket 20).

The daughter socket 20 further includes at least a daughter connecting terminal 26 adapted to be connected with another or neighboring daughter socket 20 such as shown in FIGS. 1, 5, 7 and 8.

The daughter connecting terminal 26 includes at least an output engaging portion 261 to be engaged with a daughter engaging member 25 of another or neighboring daughter socket 20 as shown in FIG. 8 for an extendible connection of plural daughter sockets 20. A coupling portion (such as a recess) 261*a* is formed on the engaging portion 261 to be engaged with an engaging portion (or a protrusion) 251 of the engaging member 25.

Figure 5:
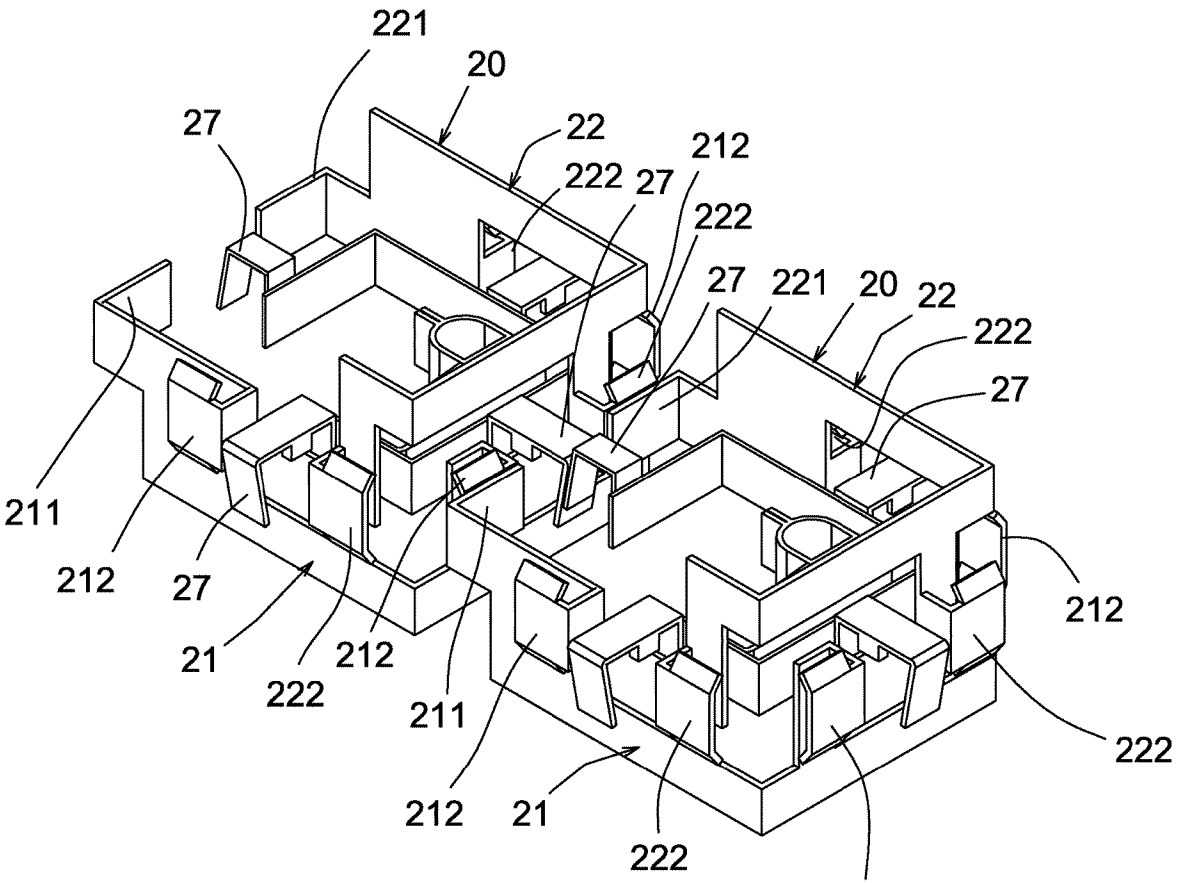
FIG. 5 shows an electrical connection between two neighboring daughter sockets.

As shown in FIGS. 8 and 5, a first output contactor 212 of first conductor 21 of one daughter socket 20 is electrically contacted with a first input contactor 211 of first conductor 21 of another or neighboring daughter socket 20, both contactors 212, 211 confined within a first wall 262*a* and a second wall 262*b* of the first sliding groove 262 of one said daughter socket 20 and also resiliently urged by said two walls 262*a*, 262*b* (FIG. 8).

Figure 7:
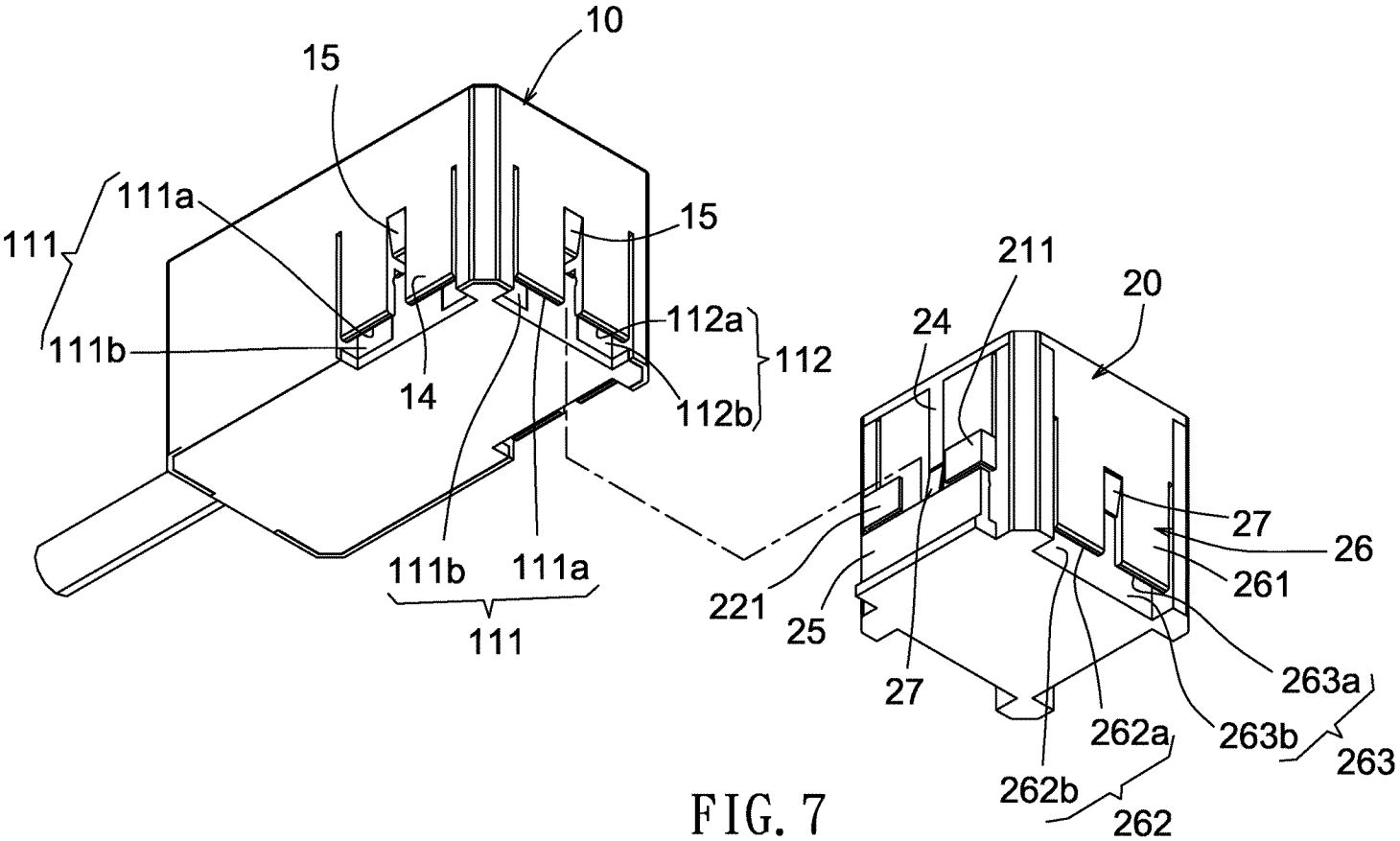
FIG. 7 is a perspective bottom view of a mother socket and a daughter socket.

Similarly, a second output contactor 222 of one daughter socket 20 is electrically contacted with a second input contactor 221 of another or neighboring daughter socket 20, both contactors 222, 221 confined within a first wall 263*a* and a second wall 263*b* of a second sliding groove 263 of one said daughter socket 20 and also resiliently urged by said two walls 263*a*, 263*b* (Note: Numerals 263*a*, 263*b*, 263 are shown in FIG. 7). By the way, the power source supply will then be led from the mother socket 10 and then passed to the two daughter sockets 20, 20 (FIG. 8). The socket 23 on the daughter socket 20 may then be plugged in by a plug for outputting electrical power source.

Figure 2:
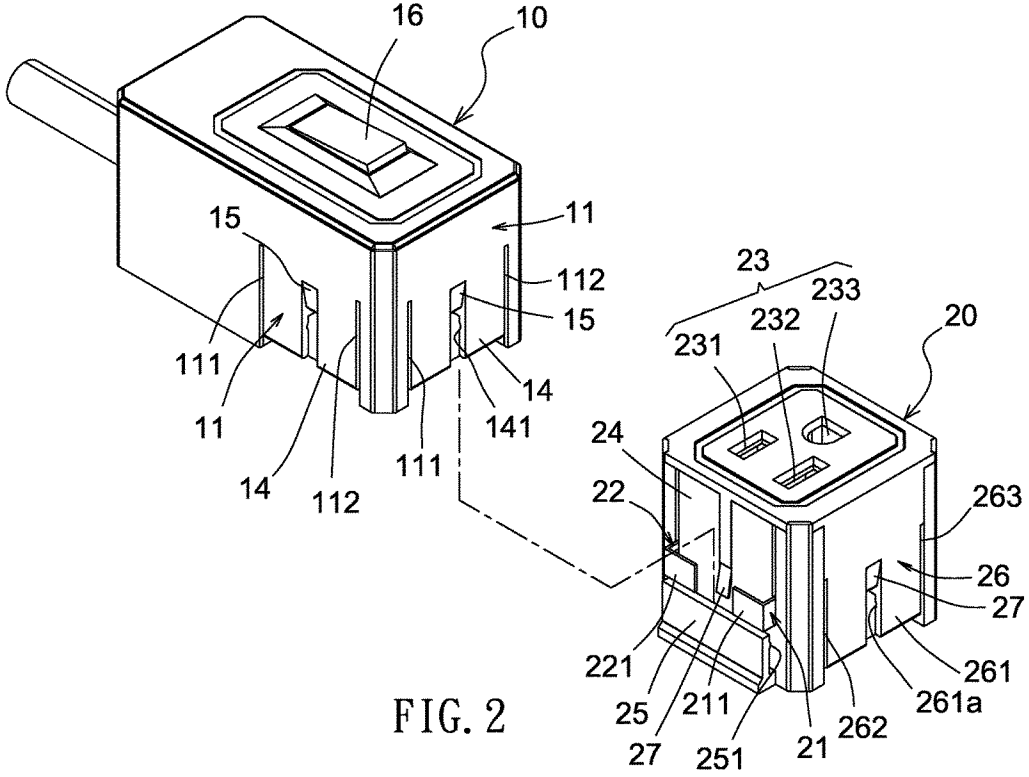
FIG. 2 shows a mother socket and a daughter socket after being assembled.

As shown in FIG. 2, the mother socket 10 is formed as a rectangular shape, having three sides each formed with a mother connecting portion 11 adapted for connecting plural daughter sockets 20 on the three sides of the mother socket 10. The mother socket 10 may also be formed as polygonal shapes, such as triangular, pentagonal, octagonal and other shapes, not limited in the present invention.

As shown in FIGS. 1, 2, 7 and 8, the mother socket 10 has its mother connecting portion 11 formed with a first sliding groove 111 and a second sliding groove 112 for accommodating the first output contactor 121 of first conducting plate 12 of mother socket 10 in the first sliding groove 111 and also for accommodating the first input contactor 211 of the first conductor 21 of the daughter socket 20 in the first sliding groove 111. A second sliding groove 112 of mother connecting portion 11 is provided for accommodating the second output contactor 131 of the mother socket 10 in the second sliding groove 112, and also for accommodating the second output contactor 221 of the second conductor 22 of the daughter socket 20 in the second sliding groove 112.

As shown in FIGS. 7 and 8, the first sliding groove 111 of the mother socket 10 includes a first wall 111*a* and a second wall 111*b* of the first sliding groove 111 adapted for resiliently clamping the first output contactor 121 of the first conducting plate 12 of the mother socket 10 and the first input contactor 211 of the first conductor 21 of the daughter socket 20 for a stable electrical contacting and connection between the first output contactor 121 and the first input contactor 211 as being resiliently urged by the two walls 111*a*, 111*b* (FIG. 8). Similarly, the second sliding groove 112 includes a first wall 112*a* and a second wall 112*b* of the second sliding groove 112 for resiliently clamping the second output contactor 131 of the second conducting plate 13 of the mother socket 10 and the second input contactor 221 of the second conductor 22 of the daughter socket 20 for a stable electrical contacting or connection between the second output contactor 131 and the second input contactor 221 as being resiliently urged by the two walls 112*a*, 112*b*.

Figure 3:
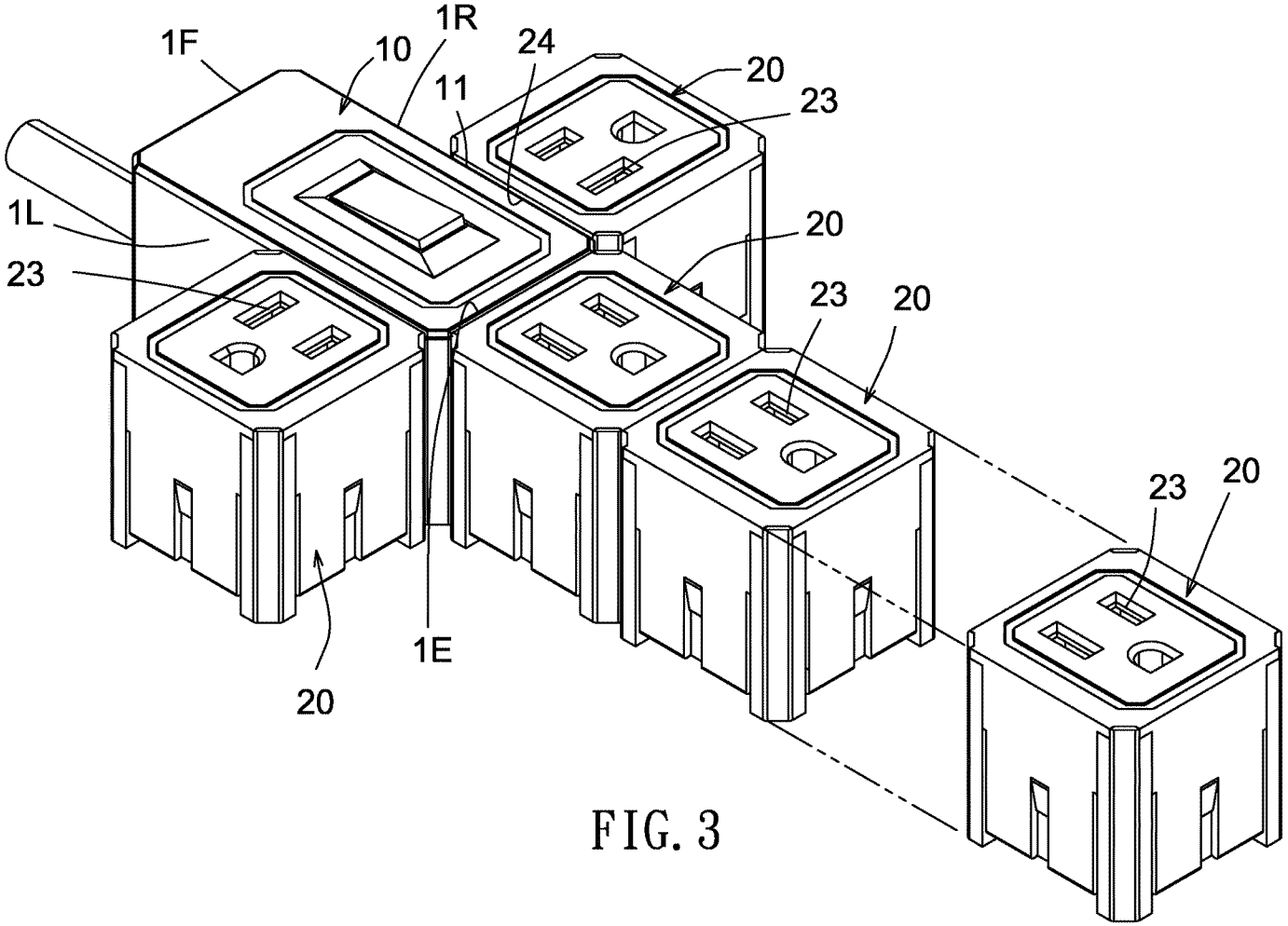
FIG. 3 is a perspective view when a mother socket extendibly connected with a plurality of daughter sockets of the present invention.
Figure 4:
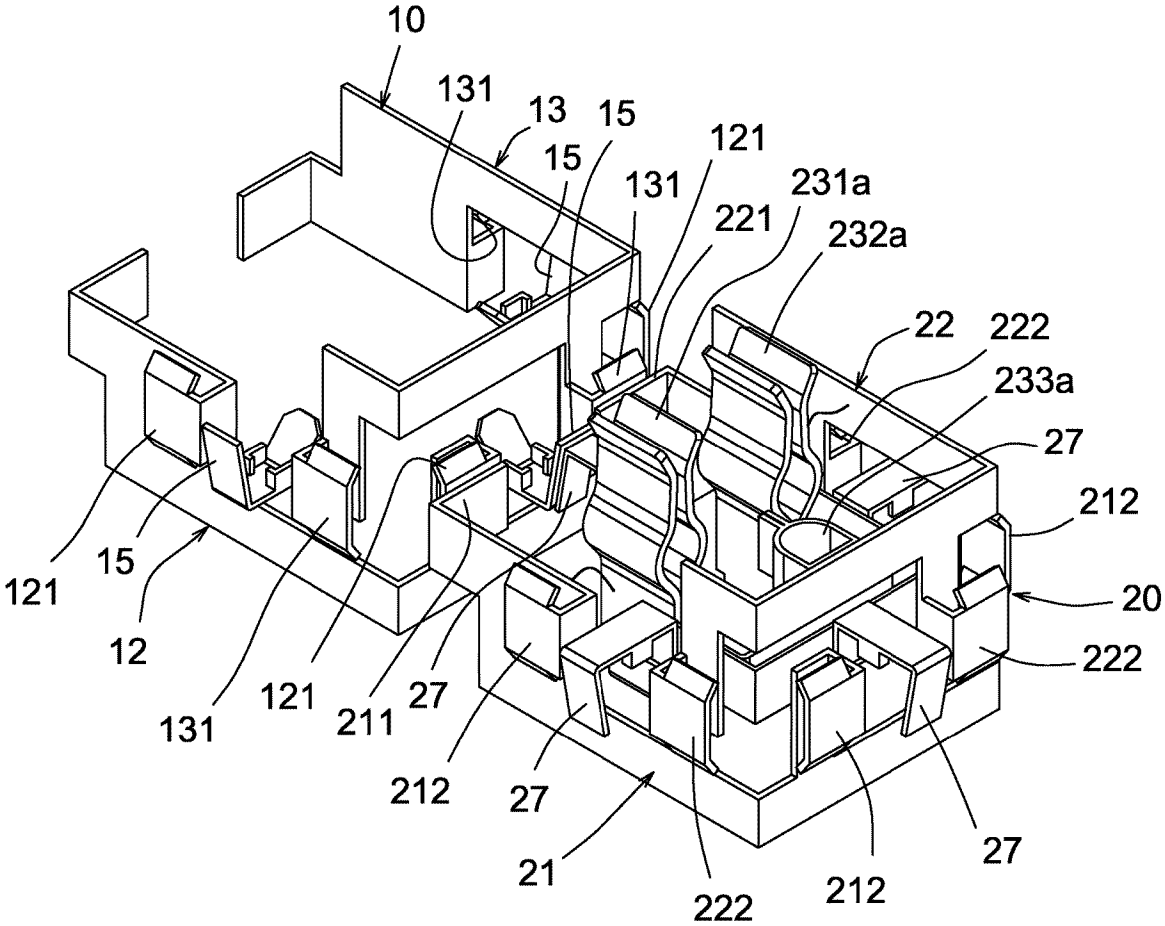
FIG. 4 is a perspective view showing the electrical connection of a mother socket with a daughter socket.

As shown in FIGS. 1, 2 and 3, the daughter socket 20 is formed as rectangular shape, having four sides, one side formed as a daughter input terminal 24, and the other three sides each formed as a daughter connecting terminal 26 respectively. Besides, the daughter socket 20 may be formed as polygonal shapes including triangular, pentagonal, hexagonal or other shapes, not limited in this invention. By the way, the daughter sockets can be extendibly connected either longitudinally along the front side 1F and rear side 1E of the mother socket 10, or connected latitudinally along a left side 1L and a right side 1R of the mother socket 10 (FIG. 3).

Figure 9:
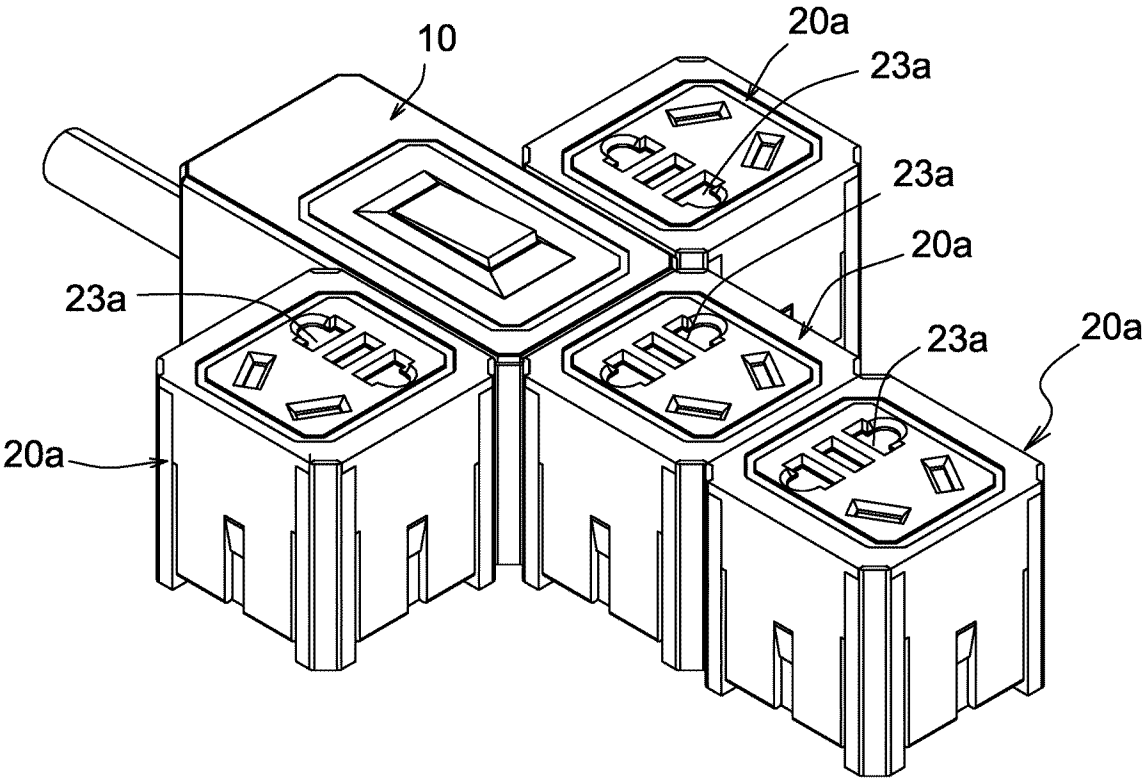
FIG. 9 shows a connection of a mother socket with a plurality of daughter dockets having several socket holes formed in each daughter socket.
Figure 10:
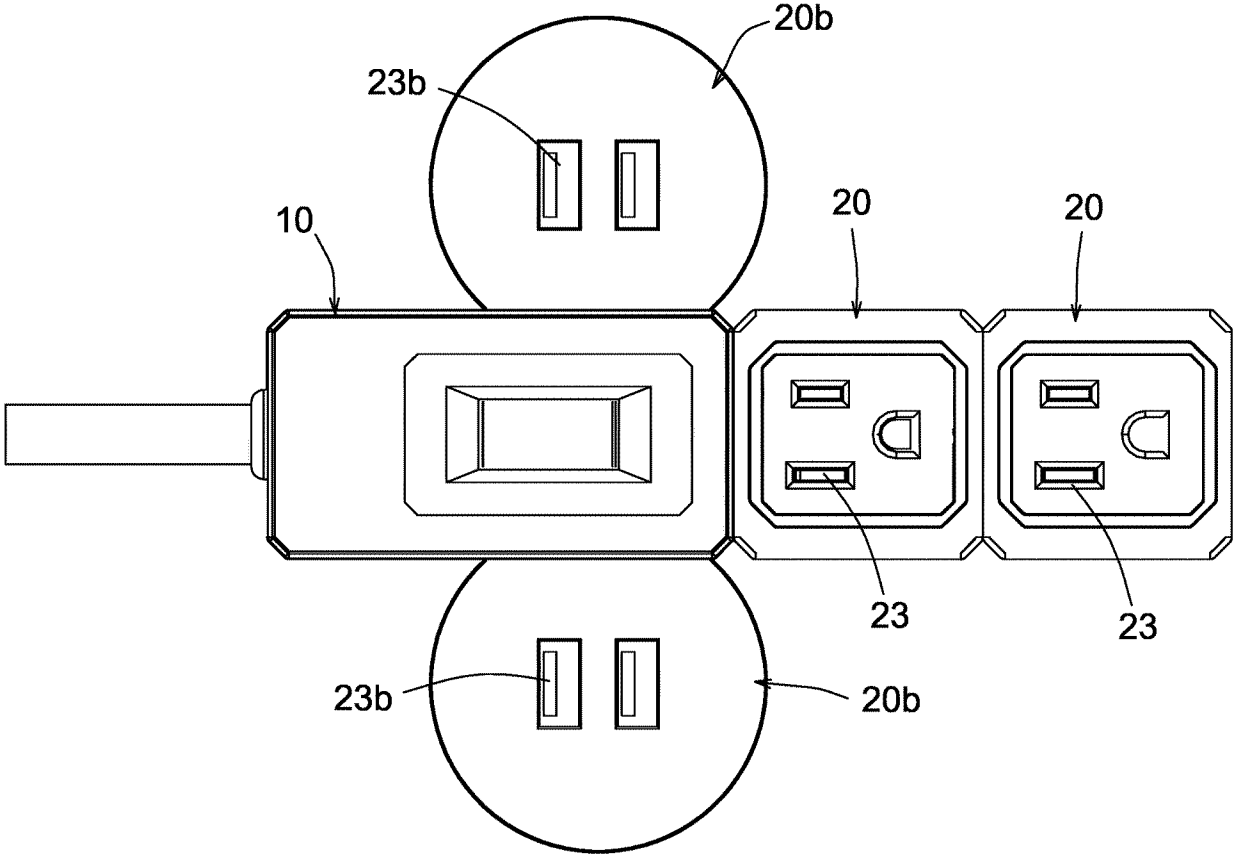
FIG. 10 shows at least a daughter socket having socket holes matching with USB specification.

As shown in FIG. 2, the socket 23 formed in the daughter socket 20 may be plugged in by a plug for outputting power supply. It is matching with the specification of USA, Taiwan and Japan. As shown in FIG. 9, the socket 23*a* of daughter socket 20*a* may also be formed to match with the specifications in China, Europe, Taiwan, etc. As shown in FIG. 10, a socket 23*b* of daughter socket 20*b* is adapted for matching with the USB specification. The present invention does not limit the forms of the sockets 23, 23*a* or 23*b*.

As shown in FIGS. 1, 2 and 5-8, the first output contactor 212 of the first conductor 21 of the one daughter socket 20 is stably contacted with the first input contactor 211 of the first conductor 21 of another or neighboring daughter socket 20 as resiliently clamped within the first wall 262*a* and the second wall 262*b* of the first sliding groove 262 in the daughter connecting terminal 26 of one said daughter socket 20 (FIG. 8). Similarly, the second output contactor 222 of the second conductor 22 of one daughter socket 20 is resiliently contacted with the first input contactor 221 of the second conductor 22 of another daughter socket 20 as resiliently clamped within the first and second walls 263*a*, 263*b* of the second sliding groove 263 in the daughter connecting terminal 26 of one said daughter socket 20.

As shown in FIG. 1, the first input contactor 211 and the first output contactor 212 may be integrally formed with the first conductor 21 of the daughter socket 20. Similarly, the second input contactor 221 and the second output contactor 222 may be integrally formed with the second conductor 22 of the daughter socket 20. Naturally, all the contactors 211, 212, 221, 222 may also be welded, soldered or fixed to the conductor 21 or 22, not limited in this invention. The contactor 211, 212, 221, 222 may be formed as a right-angle bending member to be parallel to a terminal surface of said input terminal 24 for a stable connection of the sockets 20.

Figure 14:
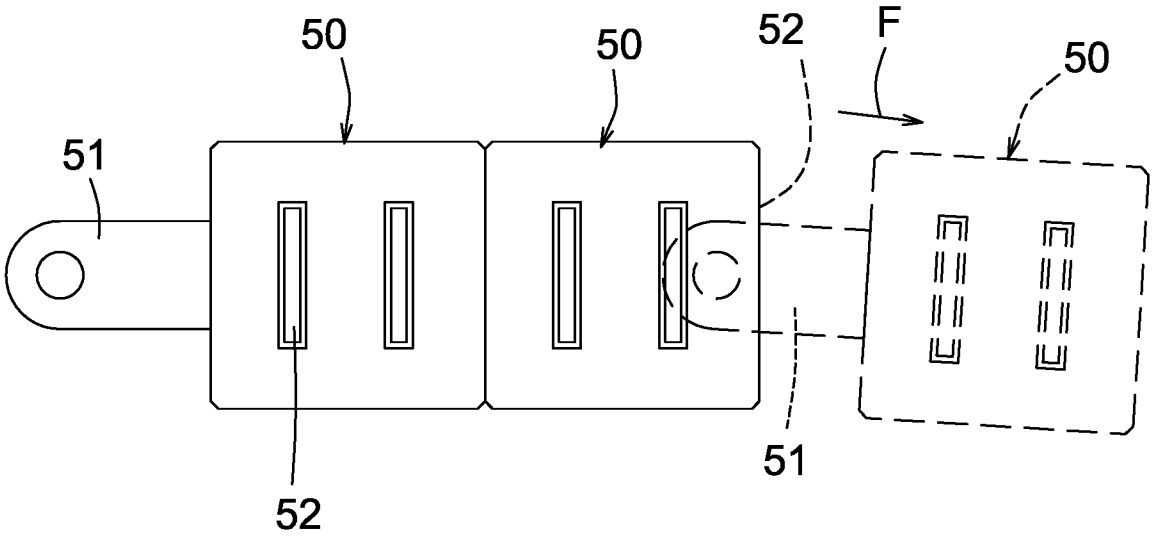
FIG. 14 Prior Art
FIG. 14 shows a prior art.

As shown in FIGS. 1 and 2, all the contactors 211, 222 are each formed as a "short hook" and adjacently formed on the first and second conductors 21, 22 to thereby reduce a total volume of the plural sockets 20 when extendibly connected. The contactor 211 or 222 is not a long pin or blade as straightly protruded outwardly from the socket as shown in the prior art (FIG. 14), thereby being conveniently used or carried.

As shown in FIGS. 1 and 2, each mother connecting portion 11 of the mother socket 10 is formed with a grounding terminal 15 which may be electrically connected to a grounding circuit (not shown) such as a grounding circuit of a power source. Similarly, each daughter input terminal 24 and each daughter connecting terminal 26 may be formed with a grounding device 27 which may be electrically connected to the grounding terminal 15 of the mother socket 10 or connected to another grounding device 27 of another daughter socket 20. A conducting clamp 233*a*, is electrically connected to the grounding device 27 of the daughter socket 20 so that a grounding pin of a plug (not shown) may be plugged therein for completing a grounding circuit for grounding purpose.

Figure 6:
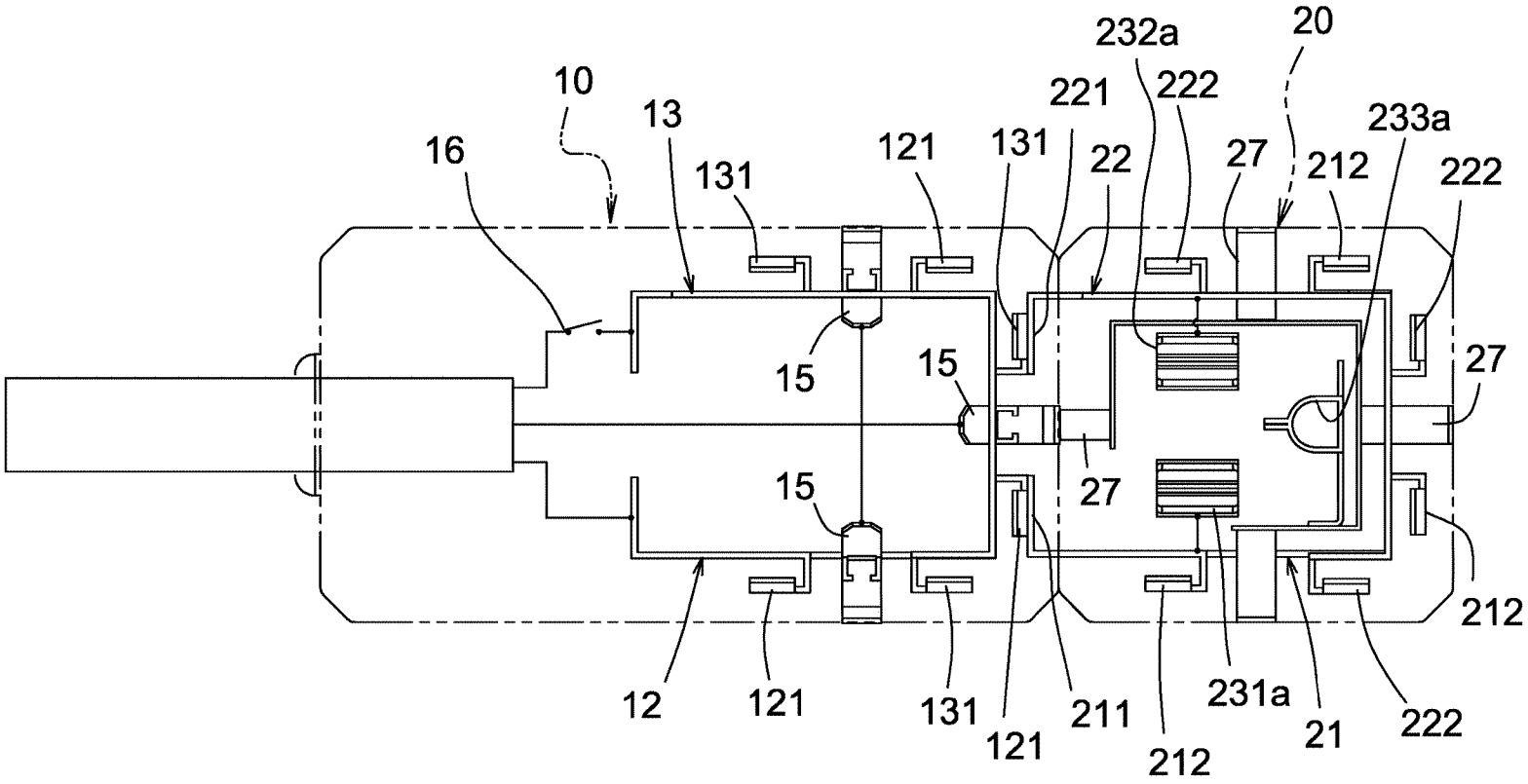
FIG. 6 is a plan view showing a mother socket connected with a daughter socket.

As shown in FIGS. 6 and 2, a control switch 16 may be provided between the first conducting plate 12 and the second conducting plate 13 for on-off control of the power connection. The switch 16 may be a mechanical switch or an electronic switch.

As shown in FIG. 1, the elements including conducting plates 12, 13 and grounding terminal 15 may be encased in a mother cover 1*a* and a mother base 1*b* for forming a casing of mother socket 14. Both cover 1*a* and base 1*b* is made of electrical insulating materials. Similarly, all elements including conductors 21, 22, conducting clamps 231*a*, 232*a*, 233*a* and grounding device 27 may be encased in a daughter cover 2*a* and a daughter base 2*b* for forming a casing of daughter socket 20.

Figure 11:
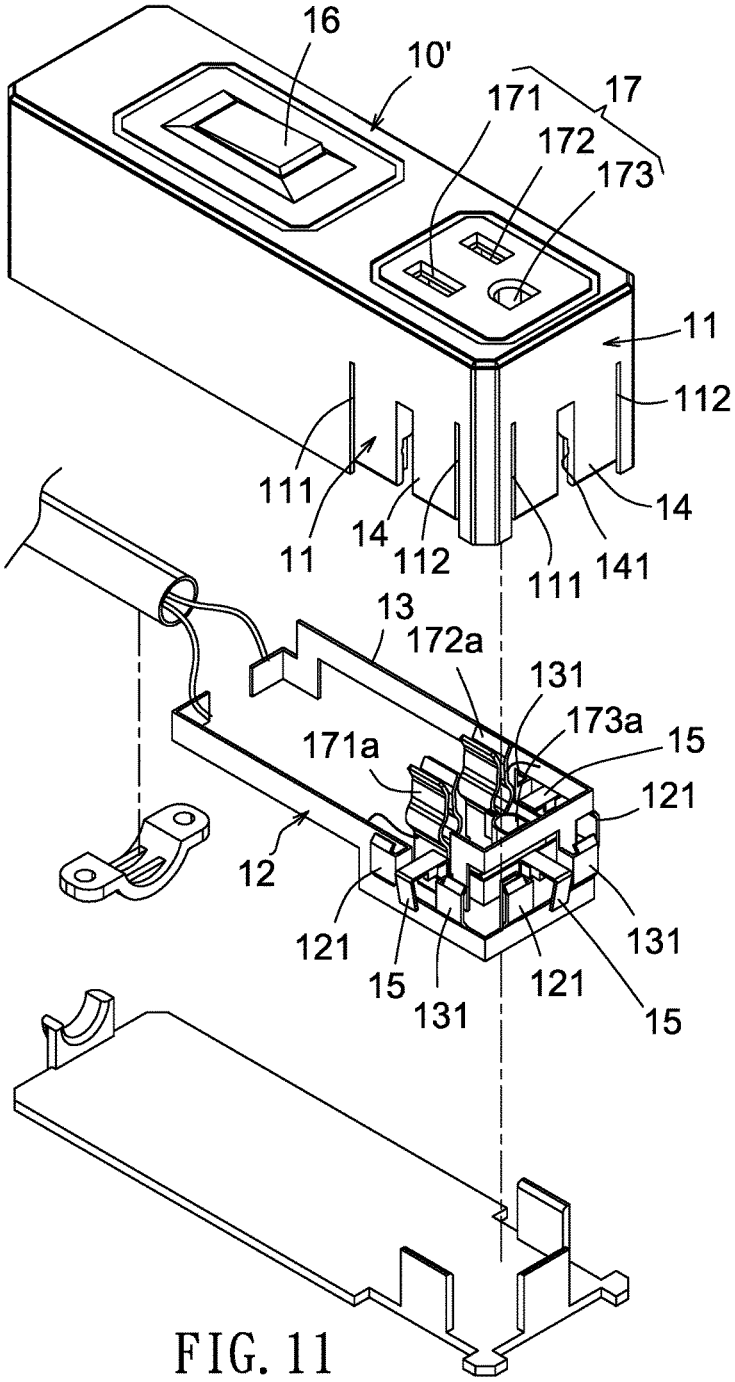
FIG. 11 shows another preferred mother socket of the present invention.
Figure 12:
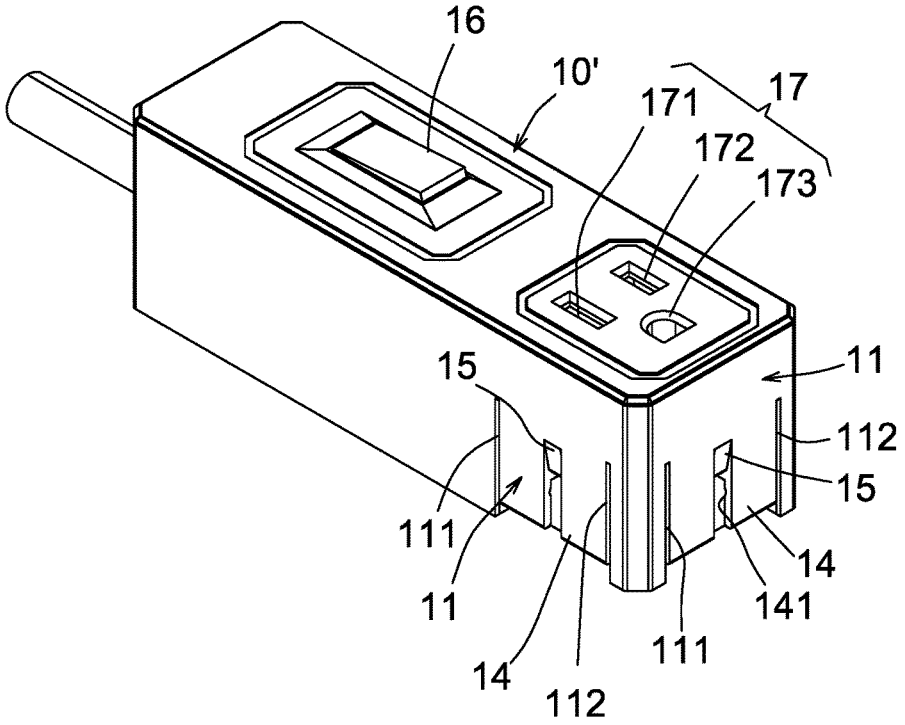
FIG. 12 is an illustration of an assembled mother socket from FIG. 11.
Figure 13:
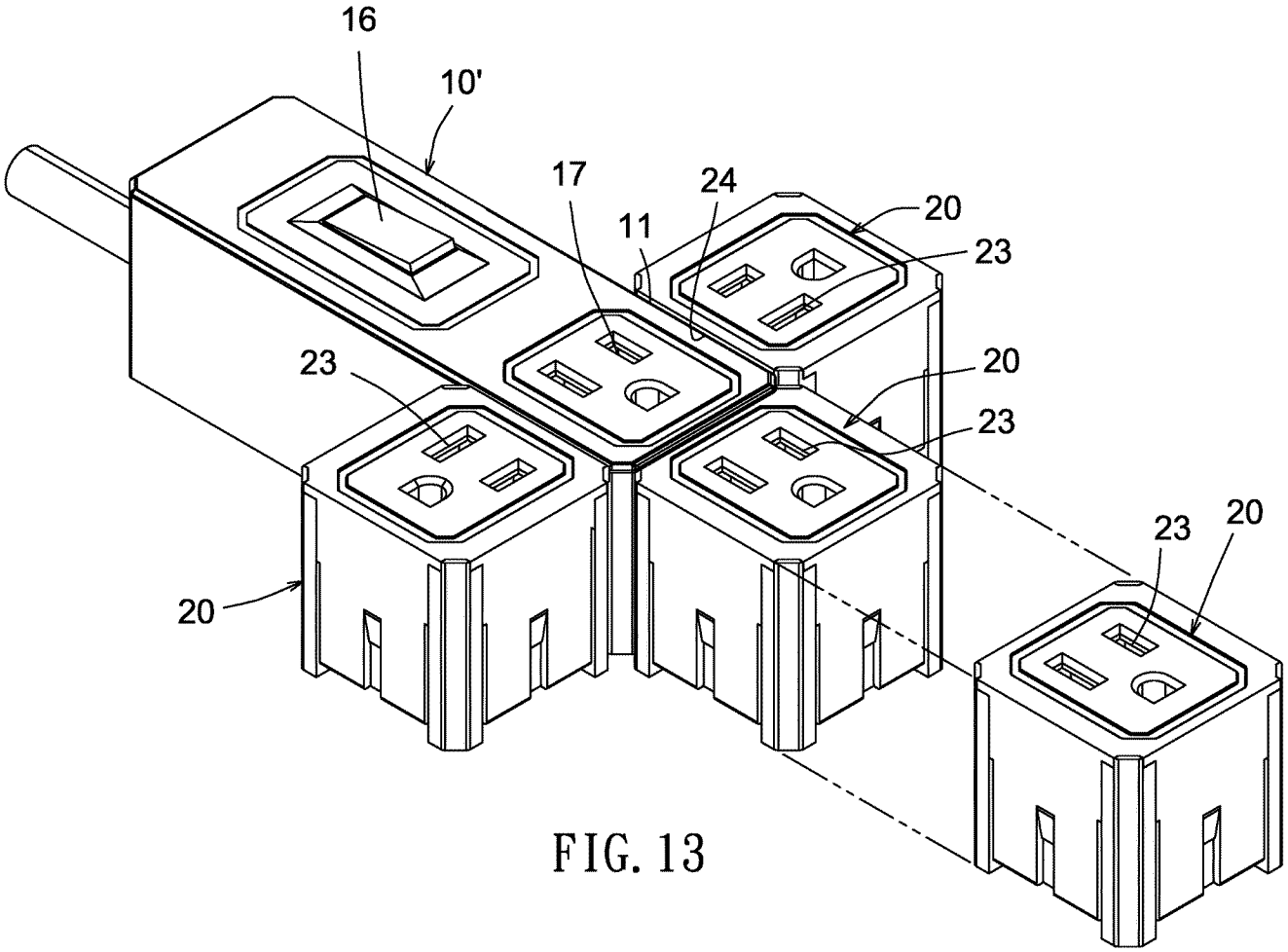
FIG. 13 is an illustration when the mother socket of FIG. 12 is connected with a plurality of daughter sockets.

As shown in FIGS. 11~13, the mother socket 10' may be further formed with a socket 17 having plural socket holes 171, 172, 173 for a direct plug-in by a plug into the mother socket 10'. Each socket hole 171, 172, 173 is respectively corresponding to a conducting clip 171*a*, 172*a*, 173*a* formed in the socket casing. One conducting clip 171*a* is electrically connected to the first conducting plate 21. Another conducting clip 172*a* is electrically connected to the second conducting plate 13. Still another conducting clip 173*a* is electrically connected to a grounding circuit (not shown).

The present invention is superior to the prior art with the following advantages:

1. The mother socket 10 is engaged or locked with a daughter socket 20, or one daughter socket 20 is locked with another daughter socket 20 by sliding engagement therebetween. So, they will not be separated when subjected to an external pulling force to thereby ensure a reliable electrical connection without worry about a temporary power disconnection, and thereby ensure a good quality of power supply.
2. Each socket is not provided with a long pin or blade for power connection so that it can be used, stored or carried very conveniently.

The present invention may be modified without departing from the spirit and scope of the present invention.

The invention claimed is:

1. An extendible electrical socket comprising:

a mother socket (10) including a mother connecting portion (11), a first conducting plate (12) and a second conducting plate (13) respectively electrically connected to two electrodes of a power source; said first conducting plate (12) having a first output contactor (121) and said second conducting plate (13) having a second output contactor (131) respectively formed in the mother connecting portion (11); a mother output terminal (14) formed on the mother connecting portion (11) and having a first engaging portion (141) formed on said mother output terminal (14); and at least a daughter socket (20) including a first conductor (21), a second conductor (22), and a socket (23); said socket (23) including a plurality of socket holes (231, 232) respectively corresponding to a plurality of conducting clips (231*a*, 232*a*) formed in said daughter socket (20), a first said conducting clip (231*a*) electrically connected to a first said socket hole (231), a second conducting clip (232*a*) electrically connected to a second said socket hole (232); said daughter socket (20) further including a daughter input terminal (24) having a daughter engaging member (25) formed on said daughter input terminal (24) defining a daughter engaging groove (250) between said daughter engaging member (25) and said daughter input terminal (24); said daughter engaging groove (250) operatively engaged with said mother output terminal (14) of said mother socket (10) by engaging a second engaging portion (251) of said daughter engaging member (25) with said first engaging portion (141) of said mother output terminal (14) for extendibly connecting said mother socket (10) with said daughter socket (20); a first input contactor (211) of said first conductor (21) of said daughter socket (20) electrically contacted with said first output contactor (121) of said first conducting plate (12) of said mother socket (10), and a second input contactor (221) of said second conductor (22) electrically contacted with said second output contactor (131) of said second conducting plate (13) of said mother socket (10); said daughter socket (20) further including a daughter connecting terminal (26) having an output engaging portion (261) formed on said daughter connecting terminal (26) and having a coupling portion (261*a*) formed on said output engaging portion (261); said output engaging portion (261) of a first said daughter socket (20) operatively engaged with said daughter engaging member (25) of a second said daughter socket (20) by engaging said coupling portion (261*a*) of said first daughter socket (20) with said engaging portion (251) of said second daughter socket (20); a first output contactor (212) of first said daughter socket (20) electrically contacted with a first input contactor (211) of second said daughter socket (20); a second output contactor (222) of first said daughter socket (20) electrically contacted with a second input contactor (221) of second said daughter socket (20), whereby a power source will be extendibly connected and output from said mother socket (10) through each said daughter socket (20).

2. An extendible electrical socket according to claim 1, wherein said mother connecting portion (111) of said mother socket (10) is formed with a first sliding groove (111) and a second sliding groove (112); said first sliding groove (111) operatively slidably inserting said first output contactor (121) of said first conducting plate (12) of said mother socket (10) and said first input contactor (211) of said first conductor (21) of said daughter socket (20) into said first sliding groove (111); said second sliding groove (112) operatively slidably inserting said second output contactor (131) of said second conducting plate (13) of said mother socket (10) and said second input contactor (221) of said second conductor (22) of said daughter socket (20) into said second sliding groove (112).

3. An extendible electrical socket according to claim 2, wherein said first sliding groove (111) includes a first wall (111*a*) and a second wall (111*b*) for resiliently clamping and electrically contacting said first output contactor (121) of said first conducting plate (12) and said first input contactor (211) of said first conductor (21) in said first sliding groove (111); and said second sliding groove (112) including another first wall (112*a*) and another first wall (112*b*) for resiliently clamping and electrically contacting said second output contactor (131) of said second conducting plate (13) and said second input contactor (221) of said second conductor (22).

4. An extendible electrical socket according to claim 1, wherein said daughter connecting terminal (26) of said daughter socket (20) further includes a first daughter sliding groove (262) and a second daughter sliding groove (263); said first output contactor (212) of said first conductor (21) electrically contacted with said first input contactor (211) of said first conductor (21) within said first daughter sliding groove (262); and said second output contactor (222) of said second conductor (22) electrically contacted with said second input contactor (221) of said second conductor (22) within said second daughter sliding groove (263).

5. An extendible electrical socket according to claim 4, wherein said first daughter sliding groove (262) includes a first daughter wall (262*a*) and a second daughter wall (262*b*) for resiliently clamping said first output contactor (212) of said first conductor (21) of one daughter socket (20) with said first input contactor (211) of said first conductor (21) of another daughter socket (20) in said first daughter groove (262); said second daughter sliding groove (263) including another first daughter wall (263*a*) and another second daughter wall (263*b*) for resiliently clamping said second output contactor (222) of said second conductor (22) of one daughter socket (20) with said second input contactor (221) of said second conductor (22) of another daughter socket (20) within said second daughter sliding groove (263).

6. An extendible electrical socket according to claim 1, wherein each said conductor (21, 22) of said daughter socket (20) is integrally formed with all said contactors and said grounding device.

7. An extendible electrical socket according to claim 1, wherein each said contactor is formed as a right-angle bending member to be parallel to a terminal surface of said input terminal (24) of said daughter socket (20).

8. An extendible electrical socket according to claim 1, wherein said mother socket (10) and said daughter socket (20) are each formed with a grounding terminal or device, which is electrically connected with one another and is electrically connected to a grounding circuit; said daughter socket (20) further including a conducting clip electrically connected to said grounding device.

9. An extendible electrical socket according to claim 1, wherein said mother socket (10) further includes a control switch (16) between each said conducting plate (21, 22) and a power source.

10. An extendible electrical socket according to claim 1, wherein said mother socket (10) further includes at least a socket hole, which is projectively aligned with a conducting clip and electrically connected to each said conducting plate respectively.

* * * * *